US007074112B2

(12) United States Patent
Olsen

(10) Patent No.: US 7,074,112 B2
(45) Date of Patent: Jul. 11, 2006

(54) APPARATUS THAT HOLDS AND TILTS A TOOL

(75) Inventor: John H. Olsen, Vashon, WA (US)

(73) Assignee: Omax Corporation, Kent, WA (US)

( * ) Notice: Subject to any disclaimer, the term of this patent is extended or adjusted under 35 U.S.C. 154(b) by 112 days.

(21) Appl. No.: 10/394,562

(22) Filed: Mar. 21, 2003

(65) Prior Publication Data

US 2004/0185758 A1 Sep. 23, 2004

(51) Int. Cl.

| | |
|---|---|
| ***B24B 49/00*** | (2006.01) |
| ***B24B 51/00*** | (2006.01) |
| ***B24B 41/00*** | (2006.01) |
| ***B24C 5/04*** | (2006.01) |
| ***B26F 3/00*** | (2006.01) |

(52) U.S. Cl. ..... 451/11; 451/340; 451/102; 83/177

(58) Field of Classification Search ..... 451/11, 451/102, 239, 340; 83/177

See application file for complete search history.

(56) References Cited

U.S. PATENT DOCUMENTS

| | | | | |
|---|---|---|---|---|
| 1,544,519 | A * | 6/1925 | McKinley et al. | 451/80 |
| 1,554,406 | A | 9/1925 | Coberty | |
| 3,081,990 | A | 3/1963 | Bromley | |
| 3,746,256 | A | 7/1973 | Hall et al. | |
| 3,765,661 | A * | 10/1973 | Omura | 266/77 |
| 4,006,890 | A | 2/1977 | Vainer et al. | |
| 4,205,828 | A | 6/1980 | Hooper et al. | |
| 4,768,702 | A * | 9/1988 | Takahashi et al. | 228/5.5 |
| 4,899,602 | A * | 2/1990 | Fender | 73/865.9 |
| 5,051,555 | A * | 9/1991 | Porterfield et al. | 219/85.16 |
| 5,286,006 | A * | 2/1994 | Ogura | 266/77 |
| 5,372,540 | A | 12/1994 | Burch et al. | |
| 5,475,196 | A | 12/1995 | Lisec | |
| 5,505,653 | A * | 4/1996 | Nedo et al. | 451/5 |
| 5,722,688 | A * | 3/1998 | Garcia | 280/789 |
| 5,759,086 | A | 6/1998 | Klingel | |

(Continued)

FOREIGN PATENT DOCUMENTS

EP 1116543 A2 7/2001

OTHER PUBLICATIONS

The Delphion Integrated View; Abstract: Cutting Torch Angle Setting Device (JP61222677A2); k. Masamichi et al.; pp. 1-2; (Mar. 4, 2003).

(Continued)

*Primary Examiner*—Joseph J. Hail, III
*Assistant Examiner*—Bryan R. Muller
(74) *Attorney, Agent, or Firm*—Graybeal Jackson Haley LLP

(57) ABSTRACT

The invention provides an apparatus that holds and tilts a tool over a tilt range and substantially about a vertex. The apparatus includes a base having pivots defining a base line and a base pivot distance. The apparatus also includes first and second pivot arms coupled to the base pivots, and a tool holder having pivots coupled to the first and second pivot arms. The tool holder pivots defining a tool holder line having a pivot distance different than the base pivot distance. The tool holder is arranged for holding the machine tool. An intersection of the base line and a selected pivot arm defines a control angle, such that changing the control angle changes a tilt of the tool holder with respect to the base line, and correspondingly tilts a longitudinal axis of the tool substantially about a vertex.

22 Claims, 6 Drawing Sheets

U.S. PATENT DOCUMENTS

| | | | | |
|---|---|---|---|---|
| 5,865,576 | A * | 2/1999 | Arai et al. | 409/201 |
| 6,201,207 | B1 | 3/2001 | Maruyama et al. | |
| 6,222,155 | B1 * | 4/2001 | Blackmon et al. | 219/121.39 |
| 6,333,487 | B1 | 12/2001 | Maruyama | |
| 6,494,240 | B1 | 12/2002 | Brisson | |
| 6,511,368 | B1 | 1/2003 | Halley | |
| 6,705,921 | B1 | 3/2004 | Shepherd | |

OTHER PUBLICATIONS

Proceedings of the 9th American Waterjet Conference, Mohamed Hashish, Ph.D., Waterjet Technology Association, Aug. 23-26, 1997, Dearborn, MI, vol. 1, pp. 1-27, 133-144, 211-302; 729-782.

International Search Report Jun. 14, 2005.

* cited by examiner

APPARATUS THAT HOLDS AND TILTS A TOOL

BACKGROUND

Five-axis machines provide an ability to translate a tool or workpiece along three orthogonal axes (X, Y and Z), and to tilt the tool about a fourth and fifth orthogonal axes. With the ability to tilt the tool, five-axis machine tools are valuable in the production of machined parts. For example, these five-axis machine tools allow a user to perform multiple cutting, abrading or drilling operations on a piece of material without having to stop operations and mount different specialized tools. This eliminates the extra time involved in setting up each specialized tool and the extra time involved in mounting the tool to the five-axis machine. Thus, the workpieces can be converted into machined parts faster and cheaper.

The ability to tilt a tool relative to a workpiece is particularly advantageous in machining workpieces with an abrasive water jet of particles fired from a nozzle at high speeds, in machining with a laser, and in painting. FIG. 1A illustrates an abrasive water jet 12 cutting a workpiece 14, and a resulting deflection distance L in the jet 12 in a direction opposite of jet motion 19. Every abrasive water jet application is affected to some extent by the deflection 18 of the abrasive water jet 12 stream from a longitudinal axis 54 as the nozzle 10 moves across the workpiece 14 in a direction indicated by motion 19. The faster the nozzle 10 moves, the more the abrasive water jet 12 is bent by the structure of the workpiece away from longitudinal axis 54. When the motion 19 of the nozzle 10 is a straight line, the abrasive water jet 12 stream cuts the material of the workpiece 14 the way a wheel cutter might cut with the stream exiting the bottom of the workpiece 14 at the deflection distance L behind the place of impact 13 where the water jet 12 stream enters the workpiece 14. On straight cuts, the stream 12 can be moved swiftly across the workpiece 14 because the stream's deflection 18 is directly inline with and behind the place of impact 13, and does not affect cutting accuracy. However, on corners, the deflection distance L can cause cutting errors as it flares to the outside or inside of a corner leaving behind or cutting undesirable deflection tapers.

Every abrasive water jet application is also affect by a bevel taper in the cut edges of the workpiece 14. FIG. 1B illustrates a bevel taper 20 in the cut edges 22*a* and 22*b* of the workpiece 14 formed by the jet 12. The jet 12 is truncated in FIG. 1B for clarity. Jet cutting, particularly with an abrasive water jet, typically produces undesirable tapered or beveled cut edges 22*a* and 22*b* in a workpiece. The widest portion of the bevel taper 18 is typically toward the place of impact 13. The bevel taper 18 looks much like a sharpened end of a pencil was dragged through the workpiece 14. The bevel taper 20 is function of material thickness, and is generally greatest in thin material where the bevel taper 20 may be 10 degrees. In thicker material such as two-inch steel, the bevel taper 20 is much less, though still significant. The bevel taper 20 is also a function of cutting speed. The bevel taper 20 becomes less as cutting speed slows, and then as cutting speed further slows beyond a point, the bevel taper 20 reverses from that illustrated in FIG. 1B becoming narrower toward the point of impact 13. The bevel taper 20 typically can only effectively be eliminated by tilting the nozzle 10 relative to the workpiece surface 15 along the X-axis. Determination of the amount of tilt required in a particular application to eliminate a bevel taper is not part of the claimed invention.

Unlike the bevel taper 20, a deflection taper may be reduced by slowing the motion 19 of the nozzle 10 across the workpiece 14. To cut complex shapes with a variety of corners and curves, the traverse speed of the motion 19 must be constantly adjusted. In addition, reducing undesirable deflection tapers requires that the abrasive water jet 12 continues removing material from the cut surfaces 16 even after the abrasive water jet 12 has penetrated the thickness of the workpiece 14. Another method of reducing undesirable deflection tapers is to make multiple passes with the abrasive water jet 12 across the workpiece 14. These methods increase time necessary to cut the workpiece 14.

An ability to tilt the nozzle 10 relative to the workpiece surface 15 provides advantages for jet cutting. For straight-line cutting, the nozzle 10 and abrasive water jet 12 can be orientated normal to the workpiece surface 15 with a compensation tilt along the X-axis to minimize the bevel taper 20 because deflection taper is not an issue. Undesirable deflection tapers in corners can be reduced by additionally tilting the nozzle 10. Alternatively, the speed of the abrasive jet's movement 19 across the workpiece 14 can be maintained in a first cut with only the compensation tilt to minimize the bevel taper 20, and then a subsequent cutting pass made across the workpiece 14 with the nozzle 10 additionally tilted to remove the deflection taper produced in the previous cutting pass. This can be quicker than making one slow cutting pass that does not produce deflection tapers.

Abrasive water-jet cutting obtains other benefits from tilting a tool 10 relative to the workpiece surface 15. For example, when the tool 10 turns an inside corner, the abrasive water jet 12 is deflected into the workpiece at the deflection distance L as the abrasive water jet 12 begins to move out of the corner. This can be minimized by beginning the movement with a tilt of the abrasive water jet 12 in the direction of movement 19 to advance only the bottom of the jet until the head and nozzle 10 can be moved in the new direction without being deflected into the workpiece. Thus, to efficiently accomplish high-speed cutting with preferred angles on the cut surfaces, the nozzle 10 may be mounted to a five-axis machine which has two orthogonal axes of horizontal translation (X and Y), one axis of vertical translation (Z), and two orthogonal axes of tilt at the nozzle 10.

Unfortunately, five-axis machines are typically expensive and can tie up a significant amount of working capital. A reason for this expense is the requirement that a five-axis machine allows cutting, grinding or drilling within very close dimensional tolerances while bearing high loads are frequently encountered in machining workpieces. The high loads result from the forced contact of the grinding wheel, drill bit, or saw blade against the workpiece. Because these conventional tools for removing material from a workpiece are mounted to the tool and require contact with the workpiece to perform, the tool must bear the loads encountered during their operation. Consequently, conventional five-axis machine tools must be robust and, thus, are typically expensive to manufacture.

When machining a workpiece with an abrasive water jet, a five-axis machine does not have to bear high loads during the cutting, grinding, or drilling process because the nozzle 10 does not contact the workpiece. Instead, the five-axis machine needs to bear the reaction load of the abrasive water jet 12 being expelled from the nozzle 10 at high speeds. This reaction load is typically much lower than the forced contact load generated by conventional grinding wheels, drill bits, or saw blades and it can be kept relatively constant during the cutting process. Consequently, the robust nature of a conventional five-axis machine is not required to operate an abrasive jet tool.

Thus, there is a need for an inexpensive apparatus for holding and tilting a tool that provides a user the ability to pivot a tool relative to a workpiece about two orthogonal working axes.

SUMMARY

The invention provides an apparatus that holds and tilts a machine tool. More particularly, an embodiment of the apparatus provides for holding and tilting a tool with respect to a base. The apparatus includes a base mountable to a machine, the base having a first base pivot and a second base pivot, the base pivots defining a base line having a base pivot distance. The apparatus also includes a first pivot arm coupled to the first base pivot, a second pivot arm coupled to the second base pivot. A tool holder has a first tool holder pivot coupled to the first pivot arm and a second tool holder pivot coupled to the second pivot arm, the tool holder pivots defining a tool holder line having a pivot distance that is different than the base pivot distance. The tool holder is arranged for holding the machine tool. An intersection of the base line and a selected pivot arm defines a control angle, such that changing the control angle changes a tilt of the tool holder with respect to the base line, and correspondingly tilts a longitudinal axis of the tool substantially about a vertex. The vertex may be defined by extending a first line through the first base pivot and the first tool holder pivot, and a second line through the second base pivot and the second tool holder pivot. The pivot arms may have equal length, and the pivots coupled to a pivot arm may allow only cylindrical movement. The apparatus may include an actuator that changes the control angle. The pivots on at least one pivot arm may constrain rotational movement of the tool holder around the base. The tool may be a cutting tool, such as jet-cutting tool, including an abrasive water-jet-cutting tool.

Another embodiment of the invention provides an apparatus that holds and tilts a tool over a tilt range and substantially about a vertex. The apparatus includes a base mountable to a machine, the base having a first, second, and third base pivots, the pivots being arranged to define a base triangle. The apparatus also includes first, second, and third pivot arms coupled to the first, second, and third base pivots, respectively. The apparatus also includes a tool holder having first, second, and third tool holder pivots coupled to the first, second, and third pivot arms, respectively, the tool holder pivots being arranged to define a tool holder triangle, and the tool holder arranged for holding the machine tool. Each pair of pivot arms and the tool holder triangle side and the base triangle side coupled by the pair of pivot arms define a four-sided figure. In this figure, the tool holder triangle side length is less than the base triangle side length, and an intersection between one side of the base triangle and one pivot arm define a control angle such that changing the control angle tilts the tool holder triangle with respect to the base triangle, which correspondingly tilts a longitudinal axis of the held tool substantially about the vertex. The vertex may be defined by extending a first line through the first base pivot and the first tool holder pivot, a second line through the second base pivot and the second tool holder pivot, and a third line through the third base pivot and the third tool holder pivot. The tilt range is more than zero and less than 20 degrees in any direction about the held-tool longitudinal axis.

A further embodiment of the invention provides an apparatus that holds and tilts a tool in an X-Y axis over a tilt range substantially about a vertex. The apparatus includes a base mountable to a machine fixed against rotation around a Z-axis and including an element defining a substantially spherically shaped virtual guide surface over the tilt range and having a center at the vertex. The apparatus also includes a tool holder arranged to rigidly hold the tool and a following element arranged to follow the spherically shaped virtual guide surface, the tool holder arranged for holding the tool with a tool longitudinal axis intersecting the vertex. The element defining the spherically shaped virtual guide surface may include a plurality of pivot arms, each arm having a first end pivotally coupled to the base and a second end pivotally coupled to the tool holder, the second ends defining the spherically shaped guide surface. The guide surface following element may include a plurality of tool holder pivots, each tool holder pivot coupled to one pivot arm second end. The element defining the spherically shaped guide surface may include a real spherically shaped guide surface member. The tool holder guide surface following member may include a substantially spherically shaped following surface. The tool may be a cutting tool, such as jet-cutting tool or an abrasive water-jet-cutting tool. The tilt range may be more than zero and less than 45 degrees in a direction about the held-tool longitudinal axis.

These and various other features as well as advantages of the present invention will be apparent from a reading of the following detailed description and a review of the associated drawings.

BRIEF DESCRIPTION OF THE DRAWINGS

The features of the present invention which are believed to be novel are set forth with particularity in the appended claims. The invention, together with further objects and advantages thereof, may best be understood by making reference to the following description taken in conjunction with the accompanying drawings, in the several figures of which like referenced numerals identify like elements, and wherein:

DETAILED DESCRIPTION

In the following detailed description of exemplary embodiments of the invention, reference is made to the accompanying drawings, which form a part hereof. The detailed description and the drawings illustrate specific exemplary embodiments by which the invention may be practiced. These embodiments are described in sufficient detail to enable those skilled in the art to practice the invention. It is understood that other embodiments may be utilized, and other changes may be made, without departing from the spirit or scope of the present invention. The following detailed description is therefore not to be taken in a limiting sense, and the scope of the present invention is defined by the appended claims.

Throughout the specification and claims, the following terms take the meanings explicitly associated herein unless the context dictates otherwise. The meaning of "a", "an", and "the" include plural references. The meaning of "in" includes "in" and "on." Additionally, a reference to the singular includes a reference to the plural unless otherwise stated or inconsistent with the disclosure herein.

Figure 1A:
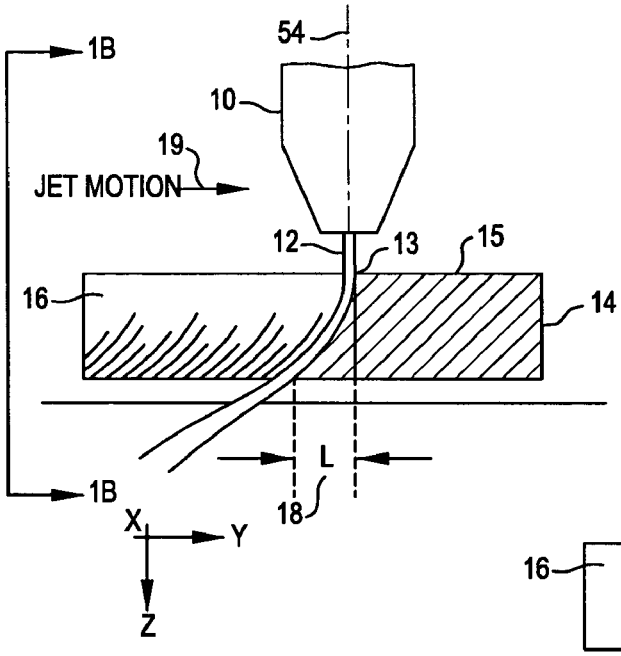
FIG. 1A illustrates an abrasive water-jet-cutting workpiece and a resulting deflection in the jet.
Figure 1B:
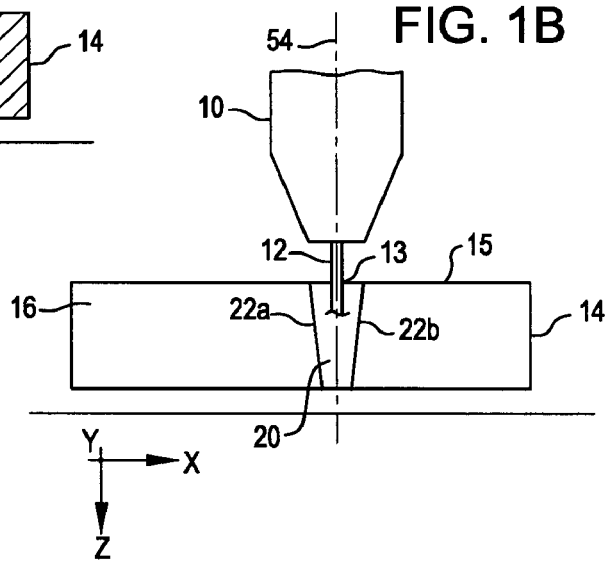
FIG. 1B illustrates a bevel taper in the cut edges of the workpiece formed by the jet.
Figure 2A:
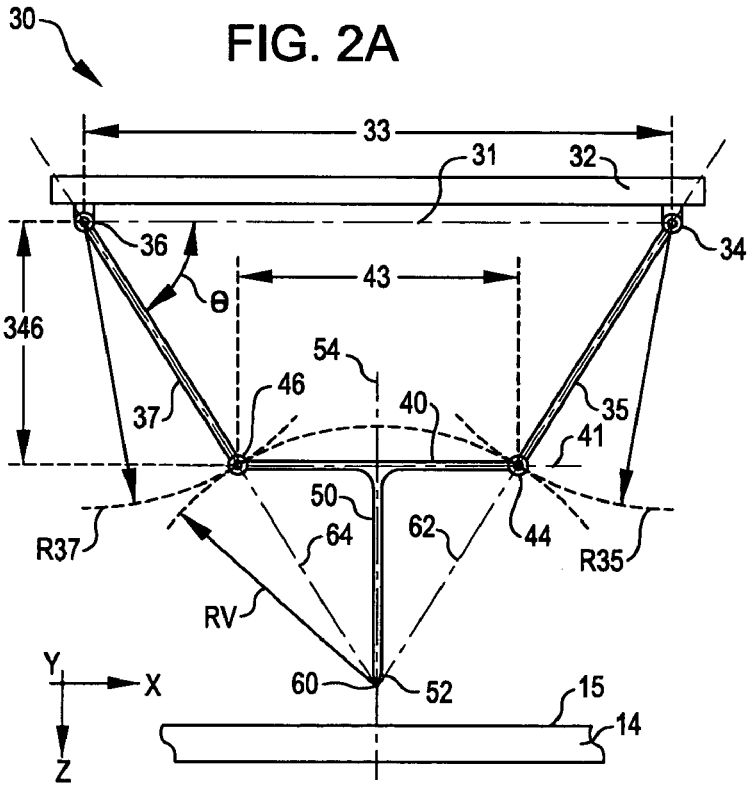
FIG. 2A illustrates an apparatus for carrying and tilting a tool about a vertex in one axis, according to an embodiment of the invention.

FIG. 2A illustrates an apparatus 30 for carrying and tilting a tool 50 about a vertex 60 in one axis, according to an embodiment of the invention. The apparatus 30 is illustrated in a first configuration where the longitudinal axis 54 of the carried tool 50 is normal to a surface 15 of a workpiece 14. The apparatus 30 includes a base 32 mountable to a machine such as an X-Y table that is fixed against rotation around a Z-axis, a tool holder 40, a first pivot arm 35 and a second pivot arm 37. The base 32 includes a first base pivot 34 and a second base pivot 36 defining a base line 31 and separated by base pivot distance 33. The tool holder 40 includes a first tool holder pivot 44 and a second tool holder pivot 46 defining a tool holder line 41 and separated by a tool holder pivot distance 43. Dimension 346 is a distance between second base pivot 36 and second tool holder pivot 46 along the Z-axis. Line 62 is projected from the first base pivot 34 through the first tool holder pivot 44, and line 64 is projected from the second base pivot 35 through the second tool holder pivot 45. Lines 62 and 64 intersect at a vertex 60. Control angle θ is any one of the angles defined within a four-sided figure formed by the base line 31, the tool holder line 41, a longitudinal axis of the first pivot arm 35, and a longitudinal axis of the second pivot arm 37. FIG. 2A illustrates the control angle θ as the angle defined by the intersection of the base line 31 and a longitudinal axis of the second pivot arm 37, such that changing the control angle θ changes a tilt of the tool holder with respect to the base line, and correspondingly tilts a longitudinal axis of the tool substantially about a vertex.

The pivots 34, 36, 44, and 46 may be cylindrical bearings permitting motion of tool holder 40 in only the X-Z plane, such as a hinge. In an alternative, the pivots 34, 36, 44, and 46 may be spherical bearings permitting motion in a plurality of planes. In a further alternative, the pivots 34, 36, 44, and 46 may include both cylindrical and spherical bearing, depending in part on the desired mobility of the tool holder 40. For example, the pivots 36 and 46 may be cylindrical bearings permitting motion of tool holder 40 only around the Y-axis and constraining rotation around the X-and Z-axis. The remaining bearings may be spherical. The tool holder pivot distance 43 is less than base pivot distance 33 in the embodiment illustrated in FIG. 2A. The components of apparatus 30 are made from any substantially rigid material for supporting the weight of apparatus 30 and the carried tool 50, resisting forces generated by a tool 50, and transmitting control movements applied to the base 32, such as steel.

The apparatus 30 may be described with reference to the vertex 60 as a triangle, a base being the base line 31, one side being a line defined between the first base pivot 32 and the vertex 60, and a second side being a line defined between the second base pivot 36 and the vertex 60. The elements of apparatus 30 may also be described as defining a four-sided figure with a base being the base line 31, a first side being the first pivot arm 35, a second side being the second pivot arm 37, and a third side being the tool holder line 41 running between the first and second pivot arms 35 and 37. Because of a geometric relationship defined by the elements of the apparatus 30, a control angle change Δθ correspondingly changes the three remaining angles defined within the four-sided figure around pivots (34, 36, 44, 46), and tilts the tool holder 40 relative to the X-axis in the X-Z plane. This also results in changing a distance along the Z-axis between a pivot of the base 32 and a pivot of the tool holder 40, such as distance 346. The degree of tilt imparted to the tool holder 40 relative to the X-axis by the control angle change Δθ is a function of the base pivot distance 33, the tool holder pivot distance 43, the difference between the base pivot distance 33 and the tool holder pivot distance 43, and the relative and absolute lengths of the pivot arms 35 and 37. Any mathematical model known in the art for describing polygons may be used to describe a tilt imparted to the tool holder 40 relative to the X-axis by a control angle change Δθ, and a corresponding tilt of the longitudinal axis 54 relative to the Z-axis, and displacement of the tool tip 52 from the vertex 60.

The physical dimension of the apparatus 30 may be selected in accordance with the desired functionality of the apparatus 30, the tool 50 to be carried, and the workpiece 14. For the purpose of describing a relationship between the apparatus 30 and a tool carried thereon, FIG. 2 illustrates the tool holder 40 carrying the tool 50, the carried tool 50 having a tool tip 52 corresponding to nozzle 10, and the longitudinal axis 54. While FIG. 2 illustrates the tool tip 52 proximate to the vertex 60 and the longitudinal axis 54 intersecting the vertex 60, the tool tip 52 may have any spatial relationship with the vertex 60. FIG. 2 illustrates an embodiment of the invention where an approximately equilateral triangle is formed. Further, the pivot arms 35 and 37 are illustrated as equal and having a length of approximately 50 percent of the distance between a base pivot and the vertex 60. When the pivot arms 35 and 37 are equal, the base line 31 is approximately parallel to the tool holder line 41, the tool holder pivot distance 43 is approximately one-half of the base pivot distance 33, and the elements of the apparatus 30 form a trapezoid in the first configuration. In other embodiments of the invention, the elements of the apparatus 30 may have any selected dimension, except the tool holder pivot distance 43 is always different than the base pivot distance 33. While the vertex 60 is illustrated as positioned between the workpiece surface 15 and the tool tip 52, the vertex 60 may be in the workpiece 14 depending on the desired functionality. Furthermore, the tool tip 52 may be positioned between the workpiece surface 15 and the vertex 60, or between the vertex 60 and the tool holder 40, also depending on desired functionality.

In another embodiment, the pivot arms 35 and 37 are made as long as possible while allowing the tool 50 to perform its function. This embodiment minimizes displacement of the tip 52 from the vertex 60 over a tilt range.

In a further embodiment, a pivot arm may be a virtual pivot arm defined by a behavior of two or more real pivot arms. For example, the pivot arm 35 and its coupled pivots 34 and 44 may be defined by behavior of two spaced apart pivot arms and their coupled pivots located in two X-Z planes a distance from the Y-axis zero position.

FIG. 2A also illustrates a geometric model of the apparatus 30. The first pivot arm 35 pivoted around pivot 34 defines an arc R35, and the second pivot arm 37 pivoted around pivot 36 defines an arc R37. The pivots 44 and 46 of the tool holder 40 pivoted around the vertex 60 in the X-Z plane define an arc RV having a radius R (not shown). When the pivot arms have the same length, the radius R is a difference between the length of line 64 and the length of a pivot arm. The arcs R35 and R37 combine to define a circular virtual guiding line with respect to the vertex 60 over small tilt angles of the tool holder 40 relative to the X-axis. When the tool holder 40 is being tilted, the arc RV may be conceptually viewed over small tilt angles of the longitudinal axis 54 as moving against, and being guided by, the circular virtual guiding line formed by arcs R35 and R37. Over small tilt angles, such as up to about five degrees, the tool tip 52 will pivot about the vertex 60 with very little displacement from the vertex 60. As the tilt angle further increases in a range between 20 and 45 degrees, the tool tip 52 will substantially pivot about the vertex 60, experiencing some displacement. The amount of displacement is a function of the geometry of the apparatus 30. Because the apparatus 30 and the tool 50 can be built with relatively low mass with respect to a typical X-Y-Z axis machine, displacements of the tool tip 52 from the vertex 60 when the tilt angle is in a range of 20 to 45 degrees can be quickly and easily compensated.

Carrying the geometric model a step further, the geometry of apparatus 30 may also be modeled as three balls, each ball having a circumferential portion touching the other two. The circumferential portions of two of the balls are visualized as forming arcs R35 and R37, which may be thought of as two virtual guide members. The third ball may be visualized as having the radius R and a circumferential portion forming an arc RV. The pivots 44 and 46 of the tool holder 50 may be visualized as being rotated around the vertex 60 and lying on the arc RV. The third ball may also be visualized as having a smaller radius than the other two. With this in mind, the arc RV portion of the third ball may be visualized as being rotated or tilted against the arcs R35 and R37 of the other two balls. The position of the vertex 60 at the center of the third ball does not shift. Using this model, it can be seen that the longitudinal axis 54 of tool 50 held by tool holder 40 (the third ball) will still intersect the vertex 60 over small angles of tilt (or rotation of the third ball). As the tilt increases, an approximation provided by this geometric model does not reflect an increasing displacement of the tool tip 52 from the vertex 60 because the pivots 44 and 46 are structurally confined to R35 and R37, and are pulled away from the arc RV.

For a two axis-tilt apparatus, such as described in subsequent figures, the geometry may be similarly modeled with four balls, each ball touching the other three. Three pivot arms may be visualized as defining three balls, the three balls providing a spherically shaped, virtual guide surface. The tool holder may be visualized as defining the fourth, and preferably smaller, ball, and defining a virtual sphere of radius R having a center that is the vertex 60. The fourth ball may be visualized by the three pivot members defining a virtual guide surface following element touching the virtual guiding surface defined by the three balls. The fourth ball may; be rotated or tilted with respect to the other three balls while maintaining contact, and the position of the vertex 60 does not shift. Using this model, as with the one-tilt-axis apparatus, it can similarly be seen that in a two-tilt-axis apparatus using pivot arms, the longitudinal axis 54 of the held tool 50 will intersect the vertex 60 over small angle of tilt. As the tilt increases, an approximation provided by this geometric model does not reflect an increasing displacement of the tool tip 52 as in the single tilt apparatus.

Figure 2B:
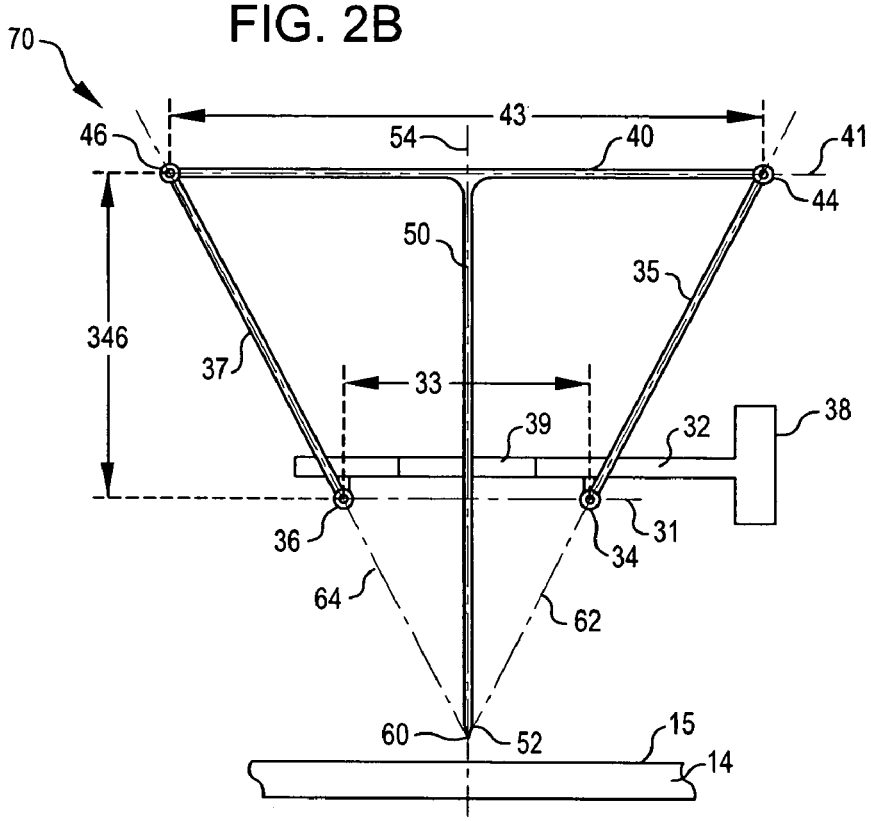
FIG. 2B illustrates an apparatus 70 for carrying and tilting a tool 50 about a vertex 60 in one axis, according to an embodiment of the invention.

FIG. 2B illustrates an apparatus 70 for carrying and tilting a tool 50 about a vertex 60 in one axis, according to an embodiment of the invention. The components of apparatus 70 are substantially similar to those of apparatus 30 illustrated in FIG. 2A except the base 32 is positioned between the vertex 60 and the tool holder 40, with the tool holder pivot distance 43 being greater than the base pivot distance 33. An aperture 39 is provided in the base 32 is provided allowing the tool tip 52 to be located proximate to the vertex 60 and moved over a tilt range. A mounting portion 38 is illustrated for mounting the base 32 to a machine, such as an X-Y-Z table that is fixed against rotation around a Z-axis. The apparatus 70 functions substantially similarly to apparatus 30 except the physical placement of the base 32 between the tool holder 40 and the vertex 60.

Figure 3:
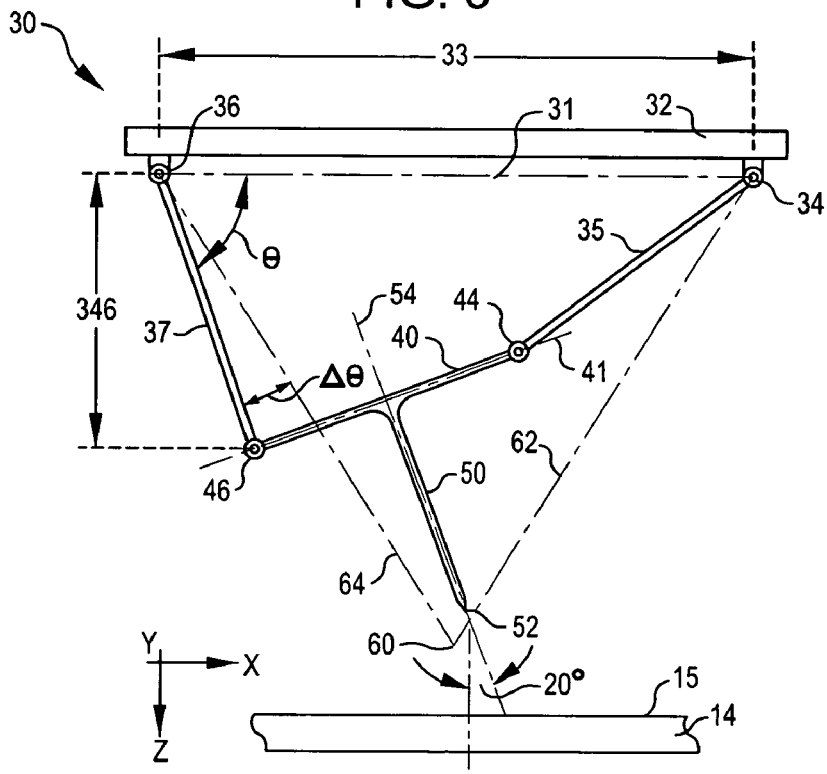
FIG. 3 illustrates a second configuration of the apparatus where a control angle change $\Delta\theta$ tilts the tool holder relative to the X-axis, according to an embodiment of the invention.

FIG. 3 illustrates a second configuration of the apparatus 30 where a control angle change $\Delta\theta$ tilts the tool holder 40 relative to the X-axis, according to an embodiment of the invention. In the second configuration, the tool holder line 41 is tilted relative to the X-axis by the control angle change $\Delta\theta$. Because of a geometric relationship established by the elements of the apparatus 30, the control angle change $\Delta\theta$ moves the apparatus 30 to the second configuration, and tilts the tool holder line 41 relative to the X-axis from that of the first configuration. A tool carried on the tool holder 40, such as the tool 50, will have its longitudinal axis 54 correspondingly tilted in the X-axis and about the vertex 60. The tilt relative to the Z-axis will be equal to the tilt of the tool holder 40 relative to the X-axis. The tool tip 52 will correspondingly be displaced only slightly along the X-axis from the vertex 60 for small tilt angles in an amount that is a function of the geometric relationship established by the elements of the apparatus 30 and the position of the tool tip 52 relative to the vertex 60.

In operation, an embodiment of the apparatus 30 uses cylindrical bearings in both ends of at least one pivot arm (35, 37) for the pivots (34, 44) or (36, 46) to resist rotational movement of the tool holder around the X-axis and the Z-axis, and allow controlled movement around the Y-axis (in the X-Z plane). The control angle change $\Delta\theta$ may be imposed by a rotational actuator (not shown) coupled between the base 32 and the second pivot arm 37 operable to rotate the second pivot arm 37 around the second base pivot 36. The control angle change $\Delta\theta$ may also be imposed by a linear actuator (not shown) coupled between the second-tool holder pivot 37 and the base 32 at an appropriate location to change dimension 346 and move second tool holder pivot 37 relative in the Z-axis. Alternatively, the linear actuator may be coupled to the second pivot arm 37 or the tool holder 40 in a similarly appropriate location instead of at second tool holder pivot 46. An abrasive water-jet-cutting tool shown as tool 50 is carried by tool holder 40. In the first configuration illustrated in FIG. 2, the nozzle 10 is positioned such that its longitudinal axis 54 is normal to and lies midpoint of a line drawn between the first and second tool holder pivots 44, 46. The nozzle 10 is further positioned such that the abrasive water jet 12 exits proximate to the vertex 60 and normal to the workpiece surface 15, and the vertex 60 is between the surface of the workpiece 15 and the nozzle 10. The abrasive water jet motion 19 is orientated to advance the nozzle 10 along the Y-axis.

When it is desired to tilt the longitudinal axis 52 of abrasive water jet 12 along the X-axis and relative to the Z-axis as illustrated in FIG. 3, the control angle change $\Delta\theta$ is imposed on the apparatus 30 using a rotational or linear actuator. As a result of the control angle change $\Delta\theta$, the tool holder line 41 is tilted relative to the X-axis, increasing the angle of incidence of the longitudinal axis 54 relative to the Z-axis and the workpiece surface 15. Any corresponding displacement of the tool tip 52 along the X-axis from vertex 60 may be compensated for by moving the base 32 in an opposite direction.

For tilt angles in a range of approximately 20 to 45 degrees in any direction, the nozzle tip 10 and its longitudinal axis 52 tilt substantially about the vertex 60, and the nozzle tip 10 moves only slightly from its original position at the vertex 60. The geometry of apparatus 30 approximates a cylindrical bearing located at the vertex 60 with its axis normal to a plane of the figure. The tool 50 can be quickly tilted around the vertex 60 with only small accelerations of the base 32 to compensate for the relatively small displacement of the tool tip 52 along the X-axis from vertex 60. This feature is particularly important in a machine where the base 32 is carried by a large moving structure in which large accelerations are either impossible or induce vibrations in the structure.

In a less preferred alternative embodiment, the actuator is omitted and the control angle change $\Delta\theta$ is imposed manually by an operator using a handle (not shown) connected to the second pivot arm 37 or the tool holder 40. A mechanism is also provided for fixing the control angle $\theta$, such as a detent mechanism.

In a further embodiment, two of apparatus 30 may be combined in any manner to provide two-axis tilting of the tool holder 40 instead of only one as illustrated in FIGS. 2 and 3. For example, a combination may include another apparatus similar to apparatus 30 and orientated in the Y-Z plane having another base including another pair of base pivots lying in the Y-Z plane and perpendicular to the base 32. The second apparatus has second holder having another pair of pivots lying in the Y-Z plane. The second holder is rigidly coupled with the base 30, such that tilting the second holder relative to the Y-axis would correspondingly tilt base 30 and the tool holder 40 relative to the Y-axis.

Figure 4:
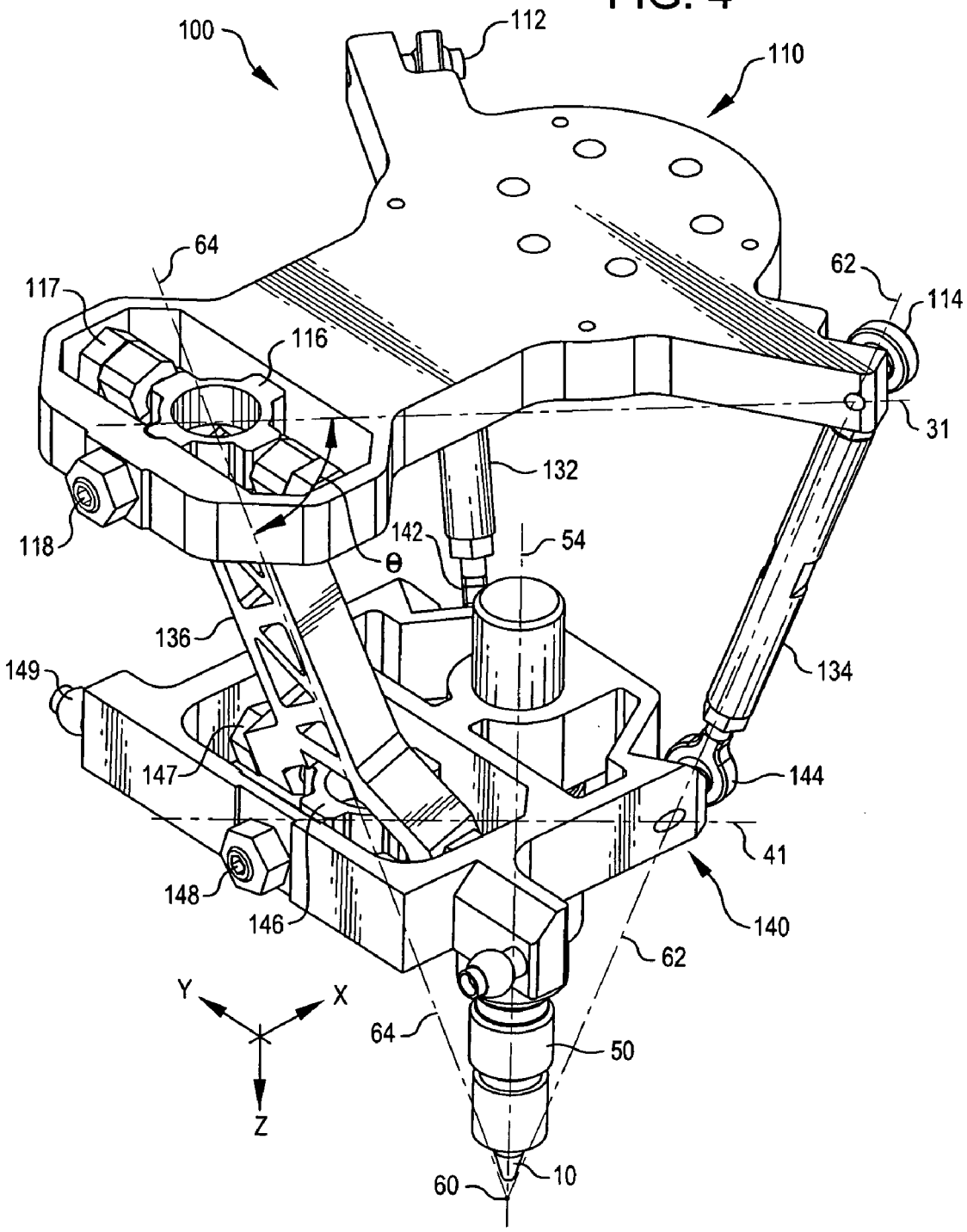
FIG. 4 illustrates a two-axis apparatus for carrying and tilting a tool about a vertex in two axes, according to an embodiment of the invention.

FIG. 4 illustrates a two-axis apparatus 100 for carrying and tilting a tool 50 about vertex 60 in two axes, according to an embodiment of the invention. The two-axis apparatus 100 is illustrated in a first configuration where the longitudinal axis 54 of the carried tool 50 will be normal to a surface 15 of a workpiece 14. The two-axis apparatus 100 includes a base 110 mountable to a machine such as an X-Y table that is fixed against rotation around a Z-axis, a tool holder 140, and pivot arms 132, 134, and 136. The base 110 includes first, second, and third base pivots 112, 114, and 116, respectively, each separated by a base pivot distance defining a pivot line in the manner of the apparatus 30. The tool holder 140 includes first, second, and third tool holder pivots 142, 144, and 146, respectively, each separated by a tool holder pivot distance defining a pivot line in the manner of the apparatus 30. Pivot arms 132, 134, and 136 are coupled between corresponding base pivots 112, 114, and 116, and tool holder pivots 142, 144, and 146, respectively.

The pivots may be spherical bearings permitting motion of the tool carrier 140 relative to the base 110 in a plurality of planes. However, if only spherical bearings are used, the tool carrier 140 needs to be restrained from rotation around the Z-axis relative to the base 110. Such rotation may be restrained in any manner known in the art. Rotation is restrained in the embodiment illustrated in FIG. 4 by using universal joints as pivots 116 and 146 allowing two degrees of freedom, i.e., rotation around the X and Y-axis, but restraining rotation around the Z-axis. The components of the two-axis apparatus 100 are made from any substantially rigid material suitable for supporting the weight of apparatus 100 and the carried tool 50, resisting forces generated by the carried tool 50, and transmitting control movements applied to the base 110, such as steel.

The two-axis apparatus 100 may be described as a tetrahedron with a triangular base plane formed between pivots 112, 114, and 116, and three planar sides meeting at the vertex 60. A first plane of the tetrahedron is defined by lines 31, 62, and 64 in a manner similar to apparatus 30. The two other tetrahedron planes are similarly defined by the other edges of the triangular base and a line drawn between the base pivot 112 and the vertex 60. The tool carrier 140 may be described as a triangular tool plane formed by pivots 142, 144, and 146 that intersects the sides of the tetrahedron. The two-axis apparatus 100 tilts the tool 50 carried in the tool carrier 140 in the X and Y axes about the vertex 60 in a manner similar to the single axis tilting of the apparatus 30 in FIGS. 2 and 3.

Figure 5:
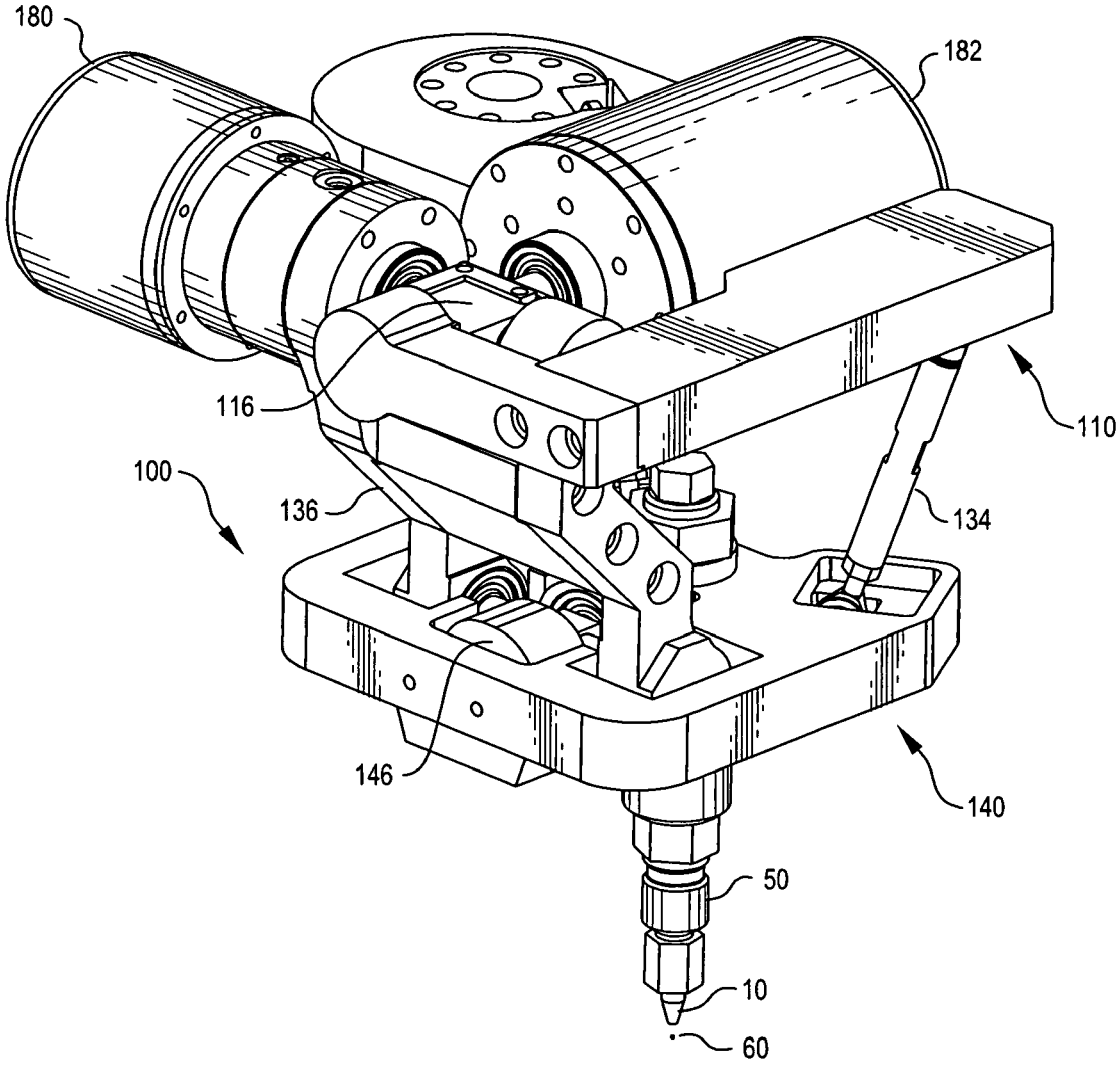
FIG. 5 illustrates the two-axis apparatus being driven with rotary actuators and coupled to the pivot, in accordance with an embodiment of the invention.

The two-axis apparatus 100 of FIG. 4 has two degrees of freedom corresponding to two tilt angles in the X and Y directions. There are numerous ways that the two-axis apparatus 100 can be actuated to produce these angles in a robotic mechanism. FIG. 5 illustrates the two-axis apparatus 100 being driven with rotary actuators 180 and 182 coupled to the pivot 116, in accordance with an embodiment of the invention. The rotary actuators 180 and 182 are arranged to change the control angles $\theta$ of the universal joints of the pivot 116 in the X and Y directions respectively, and tilt the tool holder 140 about the vertex 60.

Figure 6:
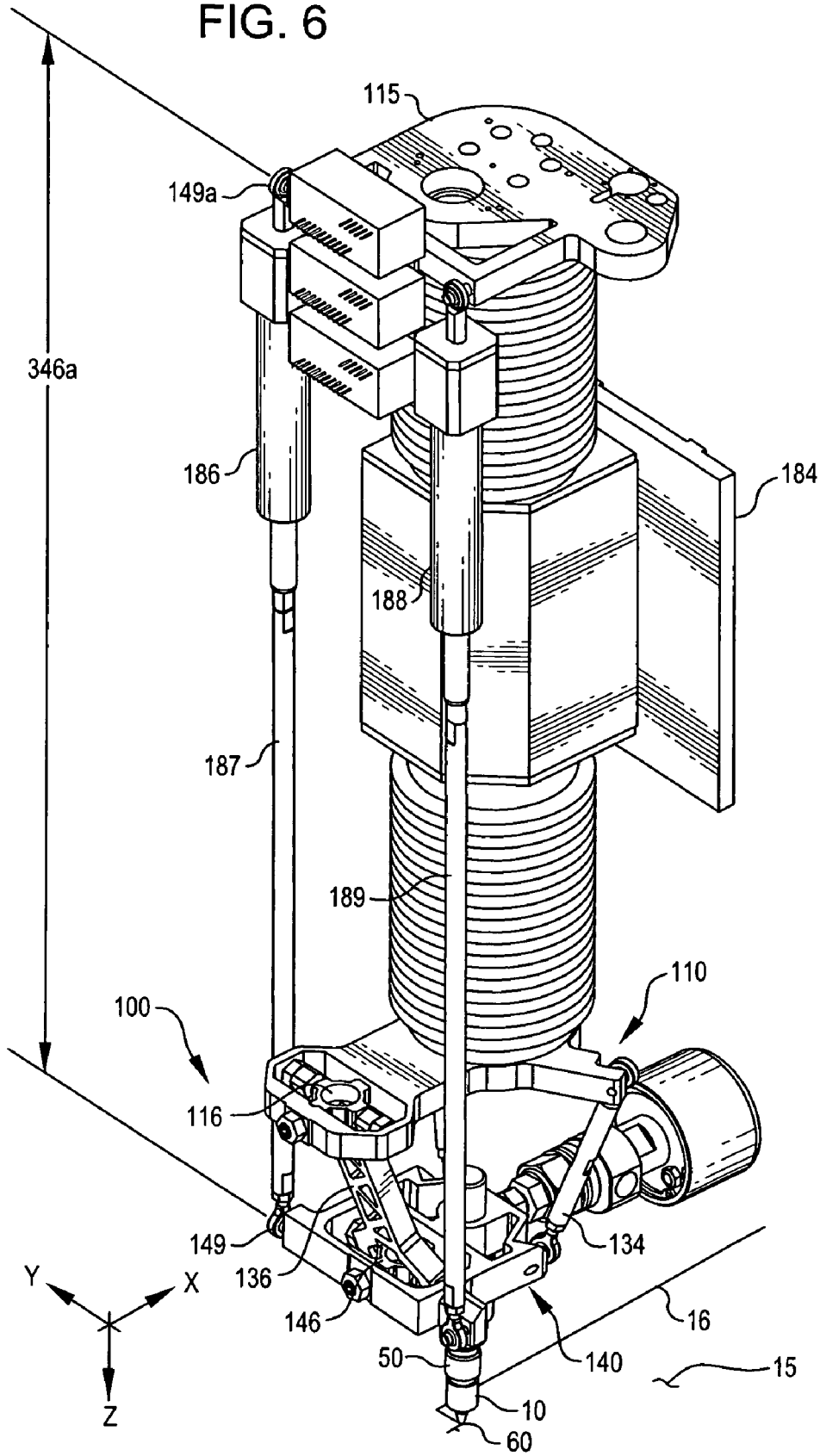
FIG. 6 illustrates the two-axis apparatus being driven with linear actuators, in accordance with an embodiment of the invention.

FIG. 6 illustrates the two-axis apparatus 100 being driven with linear actuators 186 and 188, in accordance with an embodiment of the invention. The base 110 is rigidly coupled to a top plate 115, and both are coupled to a mount 184 for mounting to a machine such as an X-Y-Z table that is fixed against rotation around a Z-axis. The tool holder 140 is moveably linked to the top plate 115 with two actuator links 187 and 189, each of which is supported on spherical bearings at the link ends. As previously described, the pivot arm 136 is connected between the base 110 and the tool holder 140 with upper and lower universal joints 116 and 146, respectively. Changeable dimension **346*a* is a length of the link 187 and its actuator 186 as measured between a top link pivot 149*a* and a tool holder link pivot 149 along the Z-axis. As with apparatus 30, changing the length of dimension 346*a* changes a control angle $\theta$ (not shown). The link 189 and actuator 188 also have changeable dimension along the Z-axis that changes another control angle $\theta$ (not shown) of the apparatus 100. If one actuator is lengthened while the other is shortened by an equal amount, tilt occurs in the Y dimension. If both actuators are lengthened or shortened by an equal amount, then tilt occurs in the X dimension The universal joints 116 and 146 form yokes providing two degrees of rotational freedom around the X- and Y-axis of the yokes, but prevent rotary motion around the Z-axis normal to yokes. The universal joints 116 and 146 thus impose a constraint that base 110 cannot rotate in the Z-axis relative to tool holder 140. The tool holder 140 tilts in two directions about the virtual pivot point 60 in a manner similar to the single direction tilting of the apparatus 30 of FIG. 2**.

Figure 7:
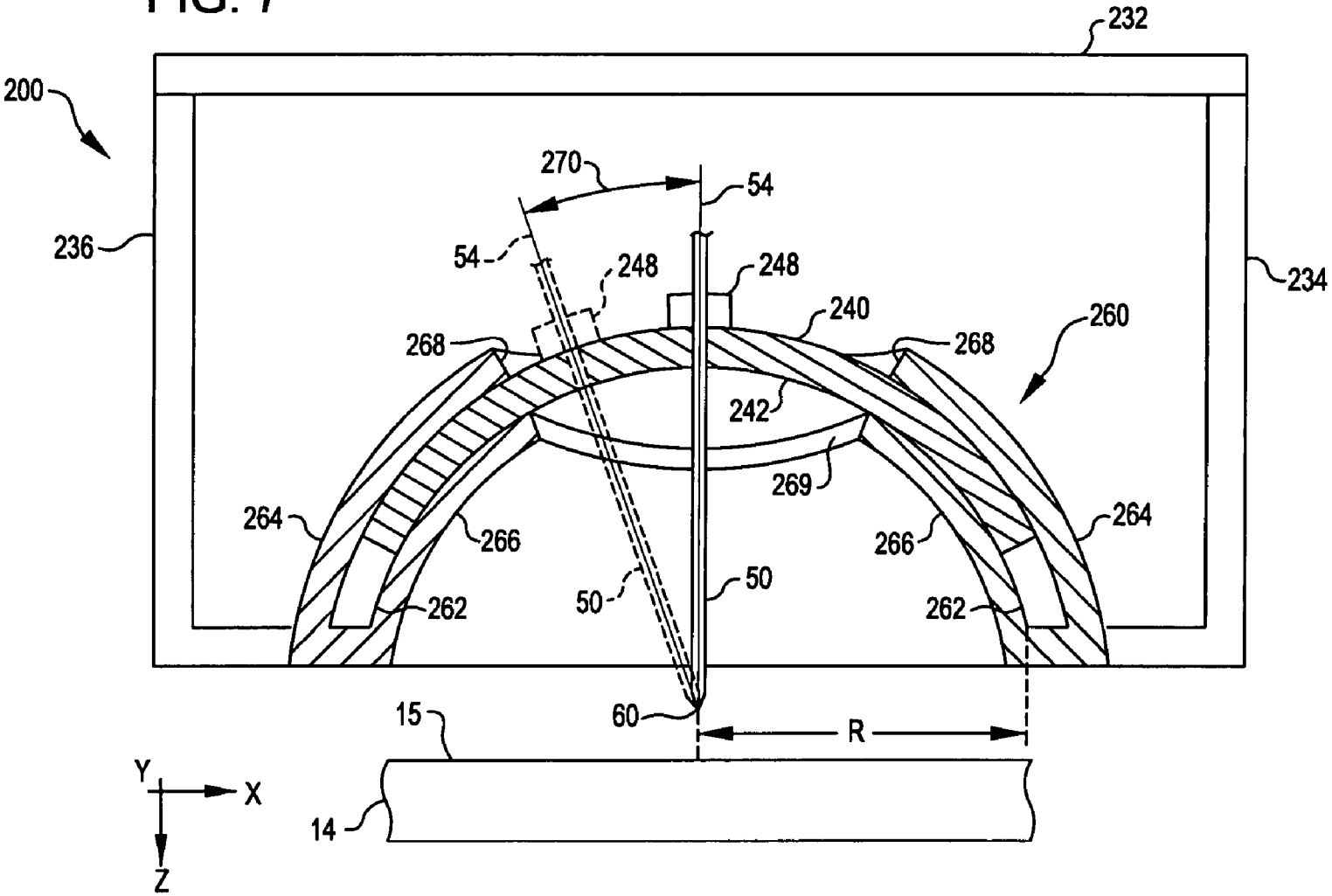
FIG. 7 illustrates a cross-sectional view of a spherical two-axis apparatus for carrying and tilting a tool about a vertex in two axes, according to an embodiment of the invention.

FIG. 7 illustrates a cross-sectional view of a spherical two-axis apparatus 200 for carrying and tilting the tool 50 about the vertex 60 in two axes, according to an embodiment of the invention. The spherical two-axis apparatus 200 is illustrated in both a first configuration where the longitudinal axis 54 of the carried tool 50 is normal to a surface 15 of a workpiece 14, and in a second configuration where the longitudinal axis 54 is tilted about the vertex 60. As used herein, references to a spherical structure include a structure including only a portion of a complete sphere, such as a partial hemisphere.

The two-axis apparatus 200 includes a base 232 mountable to a machine such as an X-Y table, a tool holder 240, and a tool holder guide 260. The base 232 includes first and second tool holder support members 234 and 236 arranged for carrying the guide 260. The tool holder guide 260 includes a lower support 266 having spherical guiding surface 262 having a radius R, an upper support 264, and cut-out areas 268 and 269 in the upper support 262 and lower support 266 respectively allow tilting movement 270 of the tool 50 carried by the tool holder 240 without obstruction. The tool holder 240 includes a spherical guiding surface 242 having the radius R for following the spherical guiding surface 262 of lower support 266, and a stop 248 limiting movement 270 by contact with a perimeter of the cut-out area 268 of the upper support 264. The components of the two-axis apparatus 200 are made from any substantially rigid material suitable for supporting the weight of apparatus 200 and the carried tool 50, resisting forces generated by the carried tool 50, and transmitting control movements applied to the base 232, such as steel.

In operation, linear actuators (not shown) may be coupled between the tool holder 240 and portions of the base 232 to provide the tilting movement 270 along both the X and the Y-axis. For example, one linear actuator may be coupled between the stop 248 and the support member 234 to provide tilting movement 270 along the X-axis. Another linear actuator may be coupled between the stop 248 and a portion of the base 232 in a manner providing the tilting movement 270 along the Y-axis. The spherical two-axis apparatus is operated substantially similar to the other embodiments described herein. A center of the spherical guiding surface 262 of the tool holder guide 260 is positioned proximate to the vertex 60. The nozzle of the cutting tool 50 is positioned such that its longitudinal axis 54 is initially normal to and passes through the vertex 60. The nozzle of the cutting tool 50 is further positioned such that the abrasive water jet 12 exits proximate to the vertex 60, and the vertex 60 is between the surface of the workpiece 15 and the nozzle.

To perform a cut, the abrasive water jet motion 19 is orientated to advance the nozzle 10 along the Y-axis. When it is desired to tilt the abrasive water jet in the X-Z plane, a linear actuator is used to provide the tilting movement 270 to the tool holder 260 in an appropriate amount. The spherical guiding surface 262 of the lower support 266 maintains the spherical guiding surface 242 of the tool holder 240 a distance R from the vertex 60 throughout the range of tilting movement 270, and the upper support 264 maintains the spherical guiding surface 242 in appropriate contact with the spherical guiding surface 262 throughout the range of tilting movement 270. When it is desired to tilt the abrasive water jet in the Y-Z plane, another linear actuator is used to provide tilting movement 270 to the tool holder 260 in an appropriate amount. As with the apparatus 100, apparatus 200 may be tilted in two directions at the same time to meet cutting requirements.

In an alternative embodiment, the tool holder 260 may include a plurality of bearings arranged to allow movement of the tool holder 260 with respect to the spherical guiding surface 262 and about the vertex 60. The bearings would perform the guiding function provided by the spherical guiding surface 242.

Although the present invention has been described in considerable detail with reference to certain preferred embodiments, other embodiments are possible. Therefore, the spirit or scope of the appended claims should not be limited to the description of the embodiments contained herein. It is intended that the invention resides in the claims.

What is claimed is:

1. An apparatus that holds and tilts a tool with respect to a base, the apparatus comprising:

(a) the base mountable to a machine, the base having a first base pivot, a second base pivot, and a third base pivot, the first and second base pivots defining a first base line having a base inter-pivot distance;

(b) a first fixed-length pivot arm coupled to the first base pivot wherein an angle between the first base line and the first pivot arm defines a control angle;

(c) a second fixed-length pivot arm coupled to the second base pivot;

(d) a third fixed-length pivot arm coupled to the third base pivot;

(e) a tool holder having a first tool holder pivot coupled to the first pivot arm, a second tool holder pivot coupled to the second pivot arm, and a third tool holder pivot coupled to the third pivot arm, the first and second tool holder pivots defining a tool holder line having an inter-pivot distance different than the base inter-pivot distance, and the tool holder arranged for holding the machine tool; and (e) a pair of actuators that changes the control angle.

2. The apparatus of claim 1, where the tool holder inter-pivot distance is less than the base inter-pivot distance.

3. The apparatus of claim 1, where the tool holder inter-pivot distance is greater than the base inter-pivot distance.

4. The apparatus of claim 1, wherein changing the control angle changes a tilt of the tool holder with respect to the base line, and correspondingly tilts a longitudinal axis of the tool.

5. The apparatus of claim 4, where tilting the tool holder over a tilt range with respect to the base line correspondingly tilts a longitudinal axis of the tool substantially about a vertex defined by an intersection of a first line defined between the first base pivot and the first tool holder pivot and a second line defined between the second base pivot and the second tool holder pivot.

6. The apparatus of claim 5, where the tilt range of the tool holder with respect to the base is less than 45 degrees.

7. The apparatus of claim 5, where the tilt range of the tool holder with respect to the base is less than 20 degrees.

8. The apparatus of claim 1, where the pivot arms have equal length.

9. The apparatus of claim 1, where the pivots coupled to at least one pivot arm allow cylindrical movement.

10. The apparatus of claim 1, where the pivots on at least one pivot arm constrain rotational movement of the tool holder around the base.

11. The apparatus of claim 1, where at least one of the actuators is a linear actuator.

12. The apparatus of claim 1, where at least one of the actuators is a rotary actuator.

13. The apparatus of claim 1, where the tool includes a cutting tool.

14. The apparatus of claim 13, where the cutting tool includes a jet-cutting tool.

15. The apparatus of claim 13, where the tool is an abrasive water-jet-cutting tool.

16. An apparatus that holds and tilts a tool, the apparatus comprising:

a base mountable to a machine, the base having a first base pivot, a second base pivot, and a third base pivot, the pivots arranged to define a base triangle;

a first fixed-length pivot arm coupled to the first base pivot;

a second fixed-length pivot arm coupled to the second base pivot;

a third fixed-length pivot arm coupled to the third base pivot; and a tool holder having a first tool holder pivot coupled to the first pivot arm, a second tool holder pivot coupled to the second pivot arm, a third tool holder pivot coupled to the third pivot arm, the tool holder pivots arranged to define a tool holder triangle, and the tool holder arranged for holding the tool, each pair of pivot arms and the tool holder triangle side and the base triangle side coupled by the pair of pivot arms defining a four-sided figure where the tool holder triangle side length is different than the base triangle side length, an intersection between one side of the base triangle and one pivot arm defining a control angle, such that changing the control angle tilts the tool holder triangle with respect to the base triangle and correspondingly tilts a longitudinal axis of the tool, and;

an actuator that changes the control angle.

17. The apparatus of claim 16, where a vertex is defined by an intersection of a first line defined between the first base pivot and the first tool holder pivot, a second line defined between the second base pivot and the second tool holder pivot, and a third line defined between the third base pivot and the third tool holder pivot, and changing the control angle tilts the tool holder triangle with respect to the base triangle over a tilt range and correspondingly tilts a longitudinal axis of the held tool substantially about the vertex.

18. The apparatus of claim 17, where the tilt range of the tool holder triangle with respect to the base triangle is more than zero and less than 45 degrees in any direction.

19. The apparatus of claim 17, where the tilt range of the tool holder triangle with respect to the base triangle is more than zero and less than 20 degrees in any direction.

20. The apparatus of claim 17, where the tool holder triangle side length is less than base triangle side length.

21. The apparatus of claim 17, where the pivots coupled to one pivot arm are operable to constrain rotational movement of the tool holder around the base.

22. The apparatus of claim 16, where the held tool is a cutting jet.

* * * * *